United States Patent [19]

Tullman

[11] 4,241,678

[45] Dec. 30, 1980

[54] DEVICE FOR AUTOMATICALLY THREADING A SEWING MACHINE

[75] Inventor: Edward J. Tullman, Union, N.J.

[73] Assignee: The Singer Company, Stamford, Conn.

[21] Appl. No.: 69,133

[22] Filed: Aug. 23, 1979

[51] Int. Cl.[3] ..... D05B 47/00

[52] U.S. Cl. ..... 112/225

[58] Field of Search ..... 112/225, 254, 259

[56] References Cited

U.S. PATENT DOCUMENTS

| | | | |
|---|---|---|---|
| 2,530,768 | 11/1950 | Hickey | 112/225 |
| 2,544,577 | 3/1951 | Weber | 112/225 |
| 2,616,381 | 11/1952 | Filip | 112/225 |
| 2,655,886 | 10/1953 | Ingwer | 112/225 |
| 3,540,392 | 11/1970 | Kaplan | 112/225 |
| 3,970,019 | 7/1976 | Coulombe et al. | 112/254 X |
| 4,010,702 | 3/1977 | Miyamoto | 112/225 |
| 4,070,977 | 1/1978 | Yamamoto et al. | 112/259 |

*Primary Examiner*—Werner H. Schroeder
*Assistant Examiner*—Andrew M. Falik
*Attorney, Agent, or Firm*—James M. Trygg; Robert E. Smith; Edward L. Bell

[57] ABSTRACT

A device for threading the stitch forming instrumentalities of a sewing machine from a thread supply up to a sewing needle. A lever is pivotally mounted in the sewing machine frame and is located at the sewing head which when pulled outwardly, thread, which has been placed across the lever, is drawn into a loop and is urged, by the lever, into a tension device, into a thread take-up lever, and under a check spring assembly.

9 Claims, 7 Drawing Figures

DEVICE FOR AUTOMATICALLY THREADING A SEWING MACHINE

DESCRIPTION

Background of the Invention

This invention relates to sewing machines, and in particular, to a thread guiding arrangement on a sewing machine for directing thread from a thread supply to a sewing needle.

In preparing to sew on a sewing machine, an operator must pass thread from a thread supply through various sewing instrumentalities prior to threading the sewing needle. This can be a tedious operation and if not performed properly, may lead to defective stitches. Various methods have been developed to simplify this task, however, they still require operator cognizance of a prescribed threading sequence and performance of various complex manipulations of the thread in the observance thereof.

The present invention alleviates this problem by enabling the operator to bring the thread directly to a thread guide adjacent to the sewing needle. Then, by manipulating the threading device of this invention, the thread is automatically passed through the various sewing instrumentalities in the proper sequence.

SUMMARY OF THE INVENTION

Accordingly, an object of this invention is to provide a device to assist in threading a sewing machine which automatically passes thread from a thread supply through the proper sequence of sewing instrumentalities.

Another object of this invention is to provide a device to simplify the procedure for threading a sewing machine which requires little operator training.

These objects are achieved in a device for threading a sewing machine which includes means for forming a loop in a thread taken from a thread supply, means for urging a first part of the loop of thread into a tension device and under a check spring assembly, guiding means on a thread take-up lever for guiding thread into an eyelet formed in the take-up lever, and means for urging a second part of the loop of thread, exiting from the check spring assembly, into the thread take-up lever guiding means.

DESCRIPTION OF THE DRAWINGS

Other objects and advantages of this invention will best be understood upon reading the following detailed description of the invention with the accompanying drawings, in which.

DESCRIPTION OF THE PREFERRED EMBODIMENT

Figure 1:
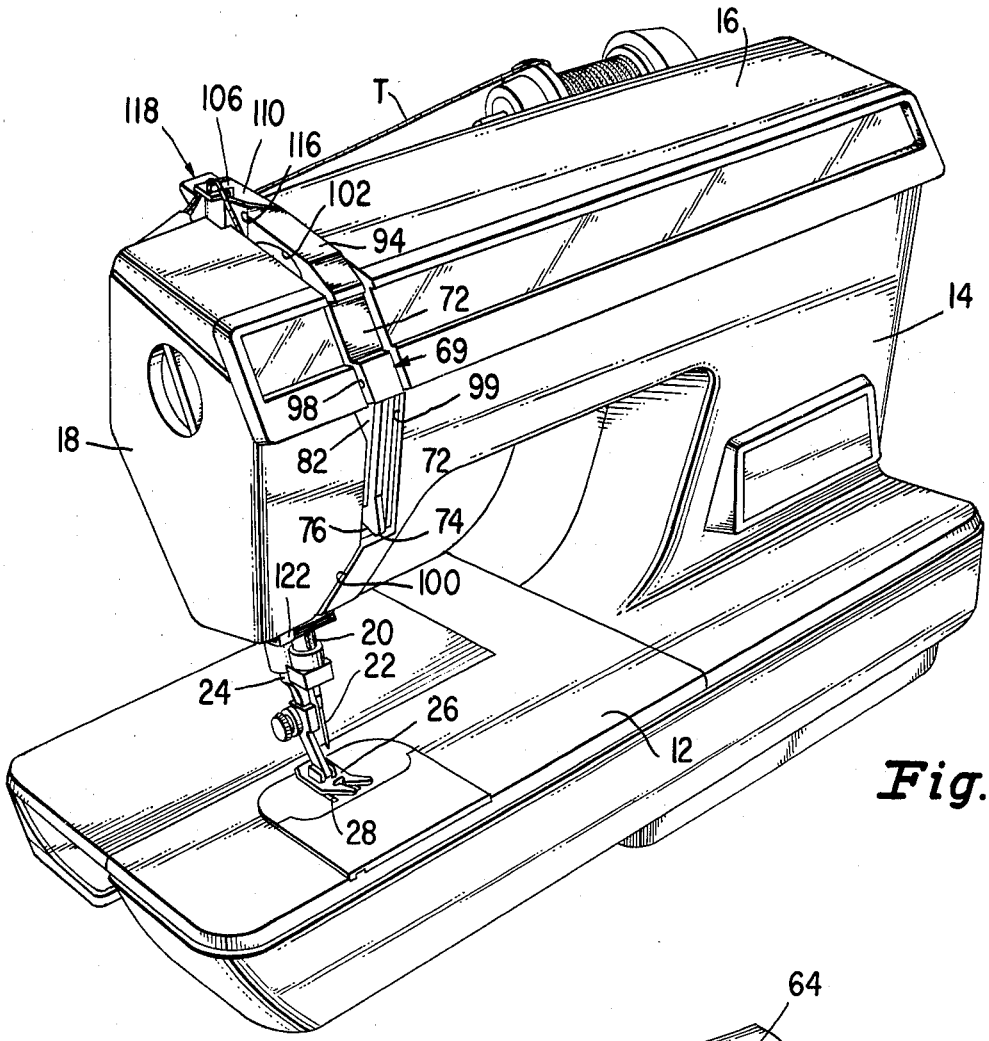
FIG. 1 is a front perspective view of a sewing machine having the invention incorporated therein.

In FIG. 1 a sewing machine is shown including a frame having a bed 12, a hollow standard 14 rising vertically from the bed 12, and a bracket arm 16 extending horizontally from the standard 14 and overhanging the bed 12. The bracket arm 16 terminates in a sewing head 18 which carries an endwise reciprocatory needle bar 20 having a sewing needle 22 removably attached to the lower end thereof. Also, carried within the sewing head 18 is a downwardly biased presser bar 24 having a presser foot 26 attached thereto for urging a material being sewn into engagement with a feed dog 28 driven by a feed mechanism (not shown).

Figure 2:
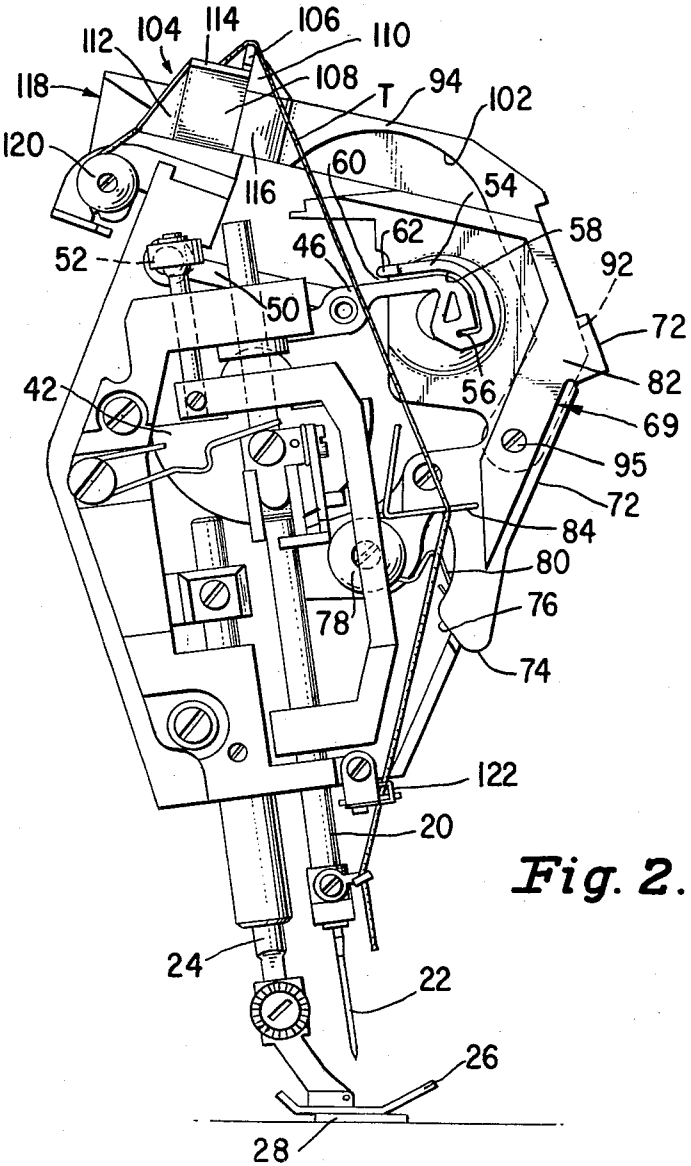
FIG. 2 is a left side elevational view of the sewing head of the sewing machine, partly in section, showing the invention in its stored position.

Referring to FIG. 2, a vertically oscillating thread take-up lever 46 is shown carried within the sewing head 18. The take-up lever 46 is driven by the crank 42 and is pivoted by an idler link 50 about a pivot post 52 affixed to the sewing machine frame. The take-up lever 46 includes an uppermost edge 54 and is formed with a thread carrying eyelet 56 in the free end thereof. A threading slot 58 is formed in the take-up lever 46 and intersects the eyelet 56 at one end thereof and terminates at an opening 60 adjacent to the uppermost edge 54. The uppermost edge 54, at the opening 60, is formed with a tab 62 which depends out of the plane of the take-up lever 46, in a direction away from the bracket arm 16, forming a means for guiding thread into the threading slot 58.

Figure 1A:
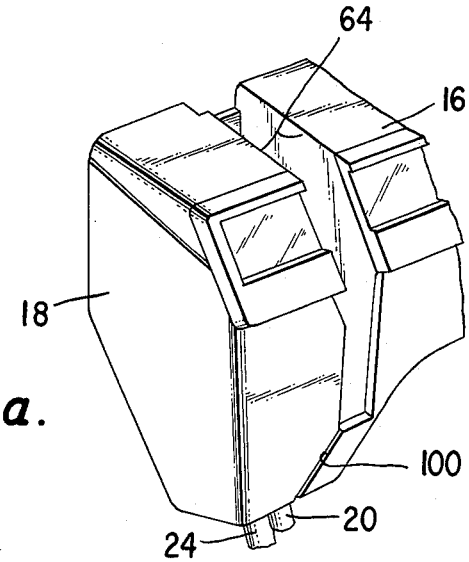
FIG. 1*a* is a perspective view of a sewing head showing the transverse slot.
Figure 6:
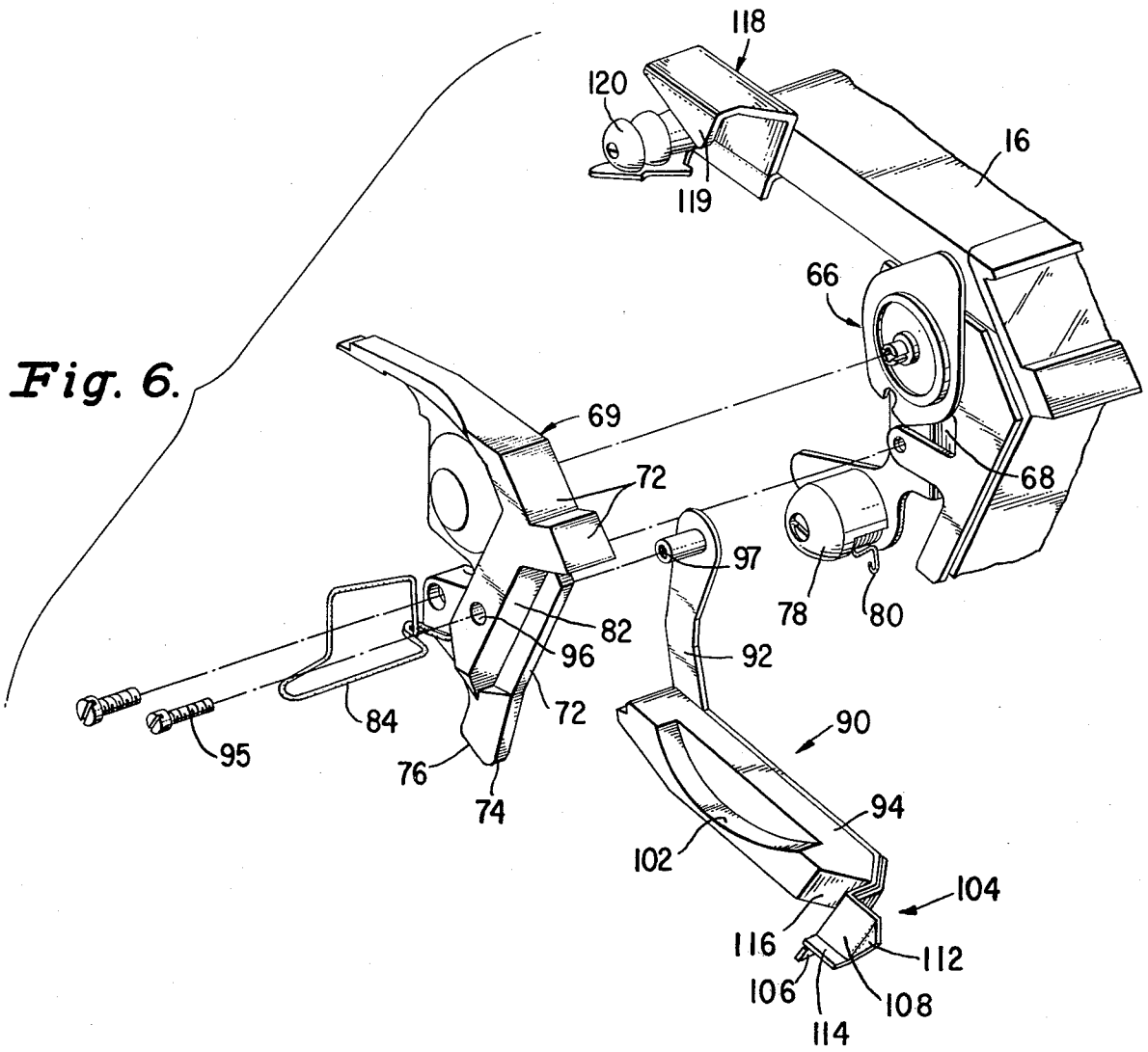
FIG. 6 is an exploded perspective view of the invention and the tension device partition to which the invention is mounted.

The take-up lever 46 is oscillated in a cavity within the sewing head 18 which lies directly beneath a transverse slot 64, shown in FIG. 1*a*, extending across the top of the bracket arm 16 and downwardly along the front thereof. As shown in FIG. 6, a thread tensioning module 66 is positioned within the sewing head 18 and includes a supporting bracket 68 to which a set of tension discs are mounted. The thread tensioning module 66 is substantially similar to the one described in U.S. Pat. No. 3,841,248, Oct. 15, 1974 of Adams, et al which is hereby incorporated by reference. The supporting bracket 68 is positioned directly within the slot 64. A partition 69, mounted to the support bracket 68, has an outermost edge 72 which is shaped to follow the contour of the bracket arm 16 and extends downwardly in the slot 64 terminating in an out-turned extremity 74 which, as shown in FIG. 1, preferably projects slightly outwardly of the bracket arm 16 contour. The partition 69 is further formed with an upwardly inclined surface 76 extending rearwardly from the extremity 74. Behind this inclined surface 76 may be found a check spring assembly 78 mounted to the frame having a forwardly extending hook-shaped projection 80 around which thread may be passed. As can be seen in FIG. 6, the partition 69 includes a thread shield 82 which is set back from the outermost edge 72 of the partition 69. The thread shield 82 is formed on the left side of the partition 69, as viewed in FIG. 6, and extends substantially the entire length thereof parallel to the edge 72. A wire thread guide 84 is also attached to the partition 69 and extends horizontally from the partition directly above the check spring assembly 78.

An L-shaped lever 90 is provided for threading the sewing machine and has a first leg 92 and a second leg 94. The lever 90 is pivotally mounted to the partition 69 by a shoulder screw 95 passing through a clearance hole 96 in the partition 69 and threaded into a threaded hole 97 in the end of the first leg 92. When the lever 90 is in a stored position, as viewed in FIG. 2, the first leg 92 lies adjacent to the partition 69 within the slot 64, while the second leg 94 lies within the slot 64 along the top of the bracket arm 16. Both of the legs 92 and 94 of the lever 90 substantially follow the countour of the bracket arm 16. The second leg 94 of the lever 90, which is significantly wider than the first leg 92, is substantially the same width as the combination of the partition 69, the thread shield 82 and the first leg 92 of lever 90. As can be seen in FIG. 1, when the lever 90 is in the stored position thereof, the lever 90, along with the partition 69 and the thread shield 82, substantially fills the slot 64 leaving two narrow left and right thread paths 98 and 99. The thread paths 98 and 99 merge below the free extremity 74 of the partition 69, at which point an angular thread slot 100 intersects the slot 64 and extends to the bottom of the sewing head 18 adjacent the needle bar 20.

The second leg 94 of the lever 90, along with that portion of the thread shield 82 lying thereunder, includes a semi-circular cut-out 102 for accommodating the uppermost swing of the thread take-up lever 46. As viewed in FIG. 6, the second leg 94 of the lever 90 includes a threader 104 at the free end thereof. The threader 104 has a first part 106 formed transverse to the second leg 94 and a second part 108 offset from the first part 106 to extend the second leg 94. The first part 106 has an inclined upper surface 110, as shown in FIG. 1, sloping downwardly toward the right thread path 99 while the second part 108 has an upper surface 112 which slopes downwardly toward the rear of the sewing machine. The threader 104 further includes an outwardly extending tab 114 which may be grasped by an operator in manipulating the lever 90. The second leg 94 of the lever 90 is formed with a V-shaped undercut 116 directly adjacent the first part 106 and opens into the left thread path 98.

A U-shaped channel 118, or upper thread guide, is mounted at one end thereof to the sewing machine bracket arm 16 and occupies a position in which a free end 119 thereof is adjacent to the second part 108 of the threader 104. A pre-tension device 120 is positioned on the back of the bracket arm 16, substantially beneath the channel 118. At the bottom of the sewing head 18, and at the end of the thread slot 100, is a lower thread guide 122.

Figure 3:
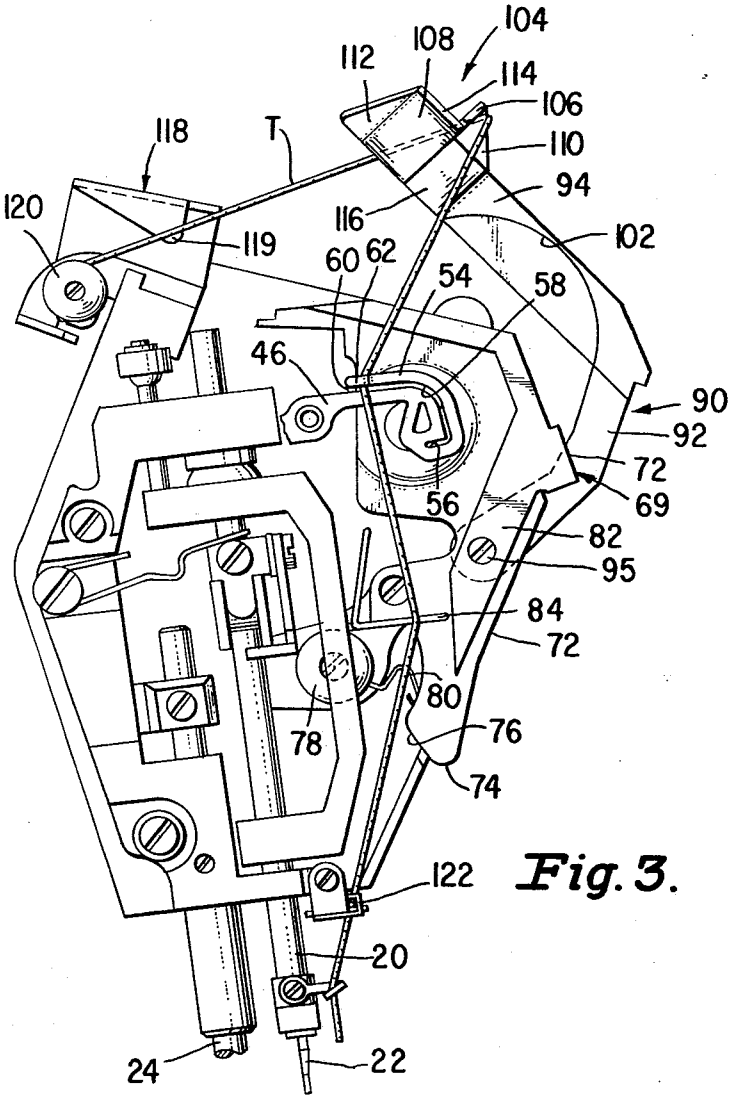
FIG. 3 is a left side partial elevational view of the sewing head, as in FIG. 2, showing the invention in a partially extended position.
Figure 5:
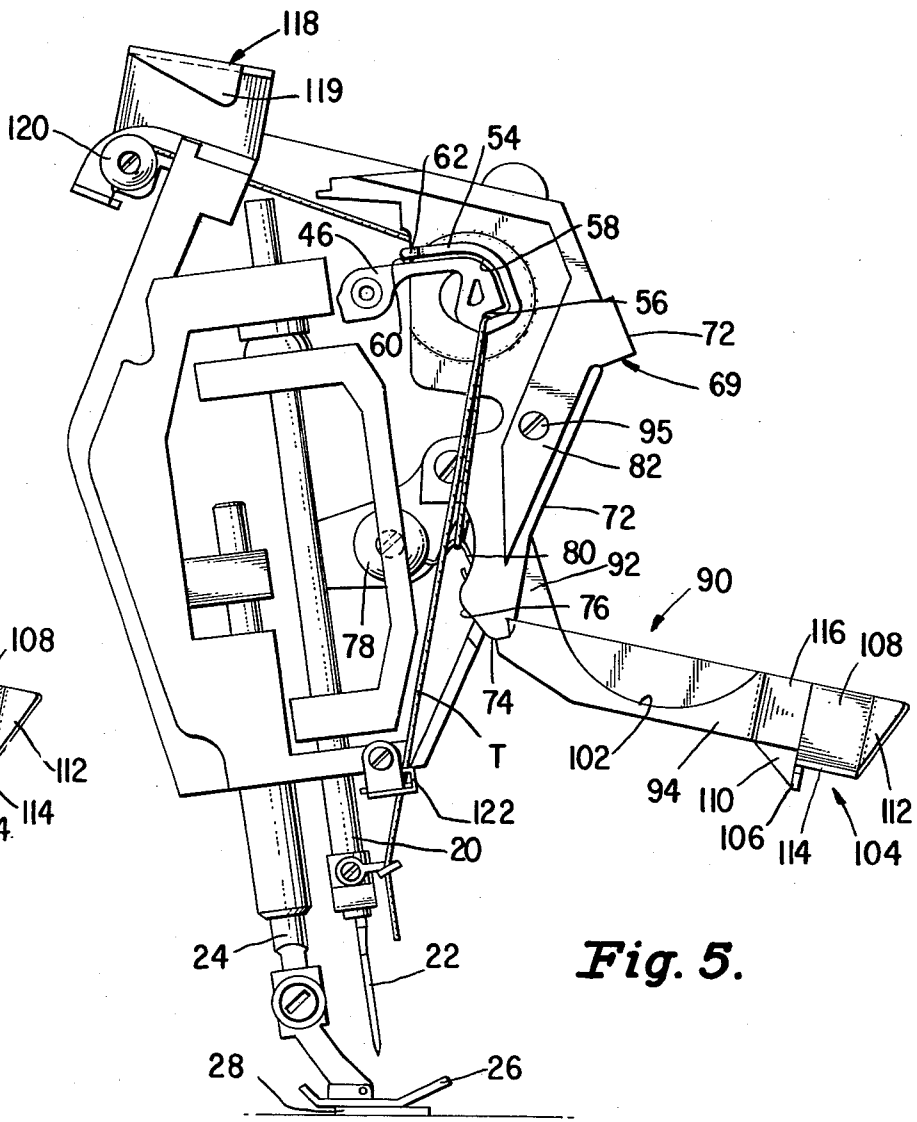
FIG. 5 is similar to FIG. 4 except the sewing instrumentalities are shown fully threaded.
Figure 4:
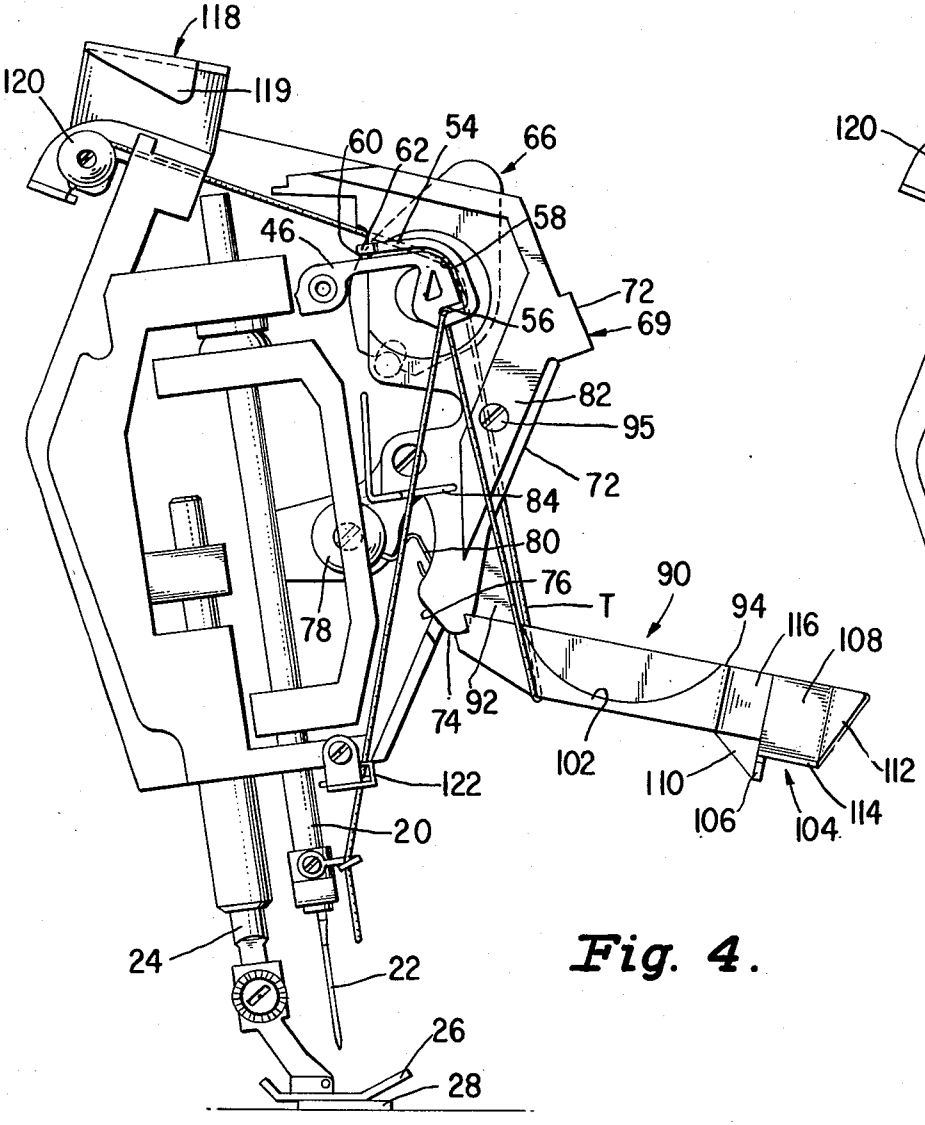
FIG. 4 is a left side partial elevational view of the sewing head, as in FIG. 3, showing the invention in the fully extended position.

In operation, to effect threading of a sewing machine having the invention incorporated thereon, thread T from a thread supply is carried around the pre-tension device 120, along the left side of the free end 119 of the U-shaped channel 118, and over the first part 106 of the threader 104. From this point, the thread T is drawn down the left thread path 98, along the thread slot 100, and into the thread guide 122 (see FIGS. 1 and 2). The operator, while retaining hold of the end of the thread T, grasps the tab 114 and begins to pivot the lever 90 about the screw 95. Referring to FIGS. 3, 4 and 5, the movement of the lever 90 causes the threader 104 to form a loop in the thread T having a limb thereof extending on opposite sides of the second leg 94 of the lever 90. The limb of the thread T loop extending into the thread path 98 enters the undercut 116 which then, along with the inclined upper surface 110 of the first part 106, aids in separating the thread T loop. When the lever 90 occupies the position shown in FIG. 3, the limb of thread T within the thread path 98 engages the tab 62 on the thread take-up lever 46 which, as the lever 90 is drawn further downwardly, guides the thread T into the threading slot 58 and on into the eyelet 56 as shown in FIG. 4. When the lever 90 is brought down to the lowest position thereof as shown in FIG. 4, the limb of thread T in the thread path 99 enters the tensioning module 66. Also, the second leg 94 of the lever 90 is now adjacent the free extremity 74 of the partition 69. If the end of thread T is now pulled, the loop of thread T will slip off the lever 90, pass under the free extremity 74 of partition 69 and engage the check spring 80 as shown in FIG. 5. The sewing machine is now threaded and the lever 90 may be returned to its stored position.

Numerous alterations in the structure herein disclosed will suggest themselves to those skilled in the art. However, it is to be understood that the present disclosure relates to one embodiment of the invention which is for purposes of illustration only and not to be construed as a limitation of this invention. All such modifications which do not depart from the spirit of the invention are intended to be included within the scope of the appended claims.

I claim:

1. In a sewing machine having a frame; various stitch forming instrumentalities including a thread tension device, an endwise reciprocatory needle bar carried within said frame, a take-up lever pivotally mounted within said frame for oscillation in a substantially vertical path in cooperative arrangement with said needle bar, and a check spring assembly for cushioning the effects of said take-up lever; actuating mechanisms for imparting endwise reciprocation to said needle bar and oscillation in said vertical path to said take-up lever; a thread supply; and a threading device for automatically threading said stitch forming instrumentalities comprising:

a. a first thread guide mounted to said sewing machine frame, said first thread guide being located intermediate a thread supply and said thread tension device;

b. a second thread guide mounted to said sewing machine frame, said second thread guide being located adjacent said needle bar;

c. said sewing machine frame being formed with a first thread path leading from said first thread guide through said thread tension device to said check spring assembly;

d. said sewing machine frame being formed with a second thread path leading from said first thread guide to said second thread guide, said first and said second thread paths intersecting one to the other at said check spring assembly;

e. said take-up lever having an uppermost edge and being formed with a thread carrying eyelet in one end thereof and a threading slot intersecting said thread carrying eyelet and extending to an opening in said uppermost edge;

f. guiding means for guiding thread into said threading slot in said take-up lever;

g. means for forming a loop of thread in said thread supply between said first and said second thread guides;

h. means for urging a first part of said loop of thread into said first thread path from said first thread guide, through said tension device and under said check spring assembly; and i. means for urging a second part of said loop of thread into said second thread path from said check spring assembly through said take-up lever guiding means and to said second thread guide, whereby the thread from said thread supply will pass through said first thread guide, through said tension device, under said check spring assembly, through said eyelet in said take-up lever, and through said second thread guide.

2. The threading device as set forth in claim 1 wherein said means for urging a first part of said loop of thread and said means for urging a second part of said loop of thread comprises a lever pivotally mounted at one end thereof in said sewing machine frame intermediate said first and said second thread paths, said lever having a first position in which said lever is congruent with said sewing machine frame and a second position in which said lever extends away from said sewing machine frame.

3. The threading device as set forth in claim 2 wherein said lever has a projection attached to the free end thereof, said projection lying adjacent said first thread guide in said first position of said lever.

4. The threading device as set forth in claim 3 wherein said lever projection includes a camming surface for guiding said first part of said thread loop into said first thread path.

5. The threading device as set forth in claim 2 wherein said tension device includes a partition extending vertically between said first and said second thread paths and said lever being pivotally mounted to said partition.

6. The threading device as set forth in claim 5 wherein said partition has a bottom portion and said check spring assembly is mounted within said sewing machine frame rearwardly of and near said bottom portion.

7. The threading device as set forth in claim 6 wherein said bottom portion of said partition is formed to guide said thread loop to said check spring assembly.

8. The threading device as set forth in claim 1 wherein said guiding means for guiding thread into said threading slot in said take-up lever comprises a portion of said uppermost edge adjacent to said threading slot extending laterally from said take-up lever and entering said second thread path.

9. The threading device as set forth in claim 1 wherein the plane of oscillation of said take-up lever is located intermediate said first and said second thread paths.

* * * * *